US006371436B1

(12) United States Patent
Westhoff et al.

(10) Patent No.: US 6,371,436 B1
(45) Date of Patent: Apr. 16, 2002

(54) PLACEMENT RING ASSEMBLY HAVING MAGNETIC SECURING MEANS

(76) Inventors: James A. Westhoff, 140 Golf Club Dr., Langhorne, PA (US) 19047; James A. Kelly, 2763 Township Rd., Reiglesville, PA (US) 18077

( * ) Notice: Subject to any disclaimer, the term of this patent is extended or adjusted under 35 U.S.C. 154(b) by 0 days.

(21) Appl. No.: 09/694,192

(22) Filed: Oct. 23, 2000

Related U.S. Application Data

(62) Division of application No. 09/079,560, filed on May 15, 1998, now Pat. No. 6,196,517.
(60) Provisional application No. 60/041,499, filed on May 16, 1997.

(51) Int. Cl.[7] ..... B28B 7/28
(52) U.S. Cl. ..... 249/63; 249/39; 249/95; 249/175; 249/184
(58) Field of Search ..... 249/35, 39, 63, 249/67, 95, 175, 184

(56) References Cited

U.S. PATENT DOCUMENTS 3,680,826 A * 8/1972 Bassani ..... 425/3
3,759,285 A * 9/1973 Yoakum
4,177,229 A * 12/1979 Moore
4,625,976 A * 12/1986 Gilbert
4,854,543 A * 8/1989 Daigle et al.

FOREIGN PATENT DOCUMENTS

JP 8-309723 * 11/1996

* cited by examiner

*Primary Examiner*—James P. Mackey
(74) *Attorney, Agent, or Firm*—Volpe and Koenig, P.C.

(57) ABSTRACT

A placement ring assembly has inside and outside mandrels releasably fastened together to secure and align a pipe connector gasket therebetween. A permanent magnet of a magnet assembly is inserted through co-aligned openings in the mandrels and is magnetically attracted to an inner-core of a casting assembly. When the cast member is set, a mechanical release is rotated to release the magnetic attraction between the permanent magnet and the mold core. One of the mandrels may be provided with shock absorbing knockout pads while the other mandrel has openings aligned with the knockout pads to enable the knockout pads to be struck with a hammer to separate the mandrels. Rubber cushioning members absorb the shock of the impacts, protecting the mandrel from permanent damage. One-piece hole formers may likewise be provided with a magnetic assembly having a mechanic release as well as knock-out pads.

11 Claims, 3 Drawing Sheets

PLACEMENT RING ASSEMBLY HAVING MAGNETIC SECURING MEANS

CROSS REFERENCE TO RELATED APPLICATIONS

This application is a division of U.S. patent application Ser. No. 09/079,560, now U.S. Pat. No. 6,196,517 B1,which was filed on May 15, 1998 and which claims benefit of U.S. Provisional Patent Application No. 60/041,499 which was filed on May 16, 1997.

FIELD OF THE INVENTION

The present invention relates to devices such as hole formers and placement rings for manhole pipe connectors cast into manhole assemblies and the like and more particularly to novel hole formers and novel two-part placement rings incorporating magnetic securement means and/or knockout means.

RELATED ART

U.S. Pat. Nos. 3,796,406; 3,813,107; 3,832,438; 4,073,048; and 4,159,829.

BACKGROUND OF THE INVENTION

Hole formers and placement ring assemblies are well known in the manhole casting field and are typically respectively utilized to accurately define an opening within a manhole base or the like and further to accurately position a manhole pipe connector gasket or hole former having a portion thereof to be embedded within the cast material.

Placement ring assemblies are conventionally formed of a metallic material and comprise first and second placement rings. A pipe connector gasket is positioned between cooperating circumferential portions of the rings and is maintained firmly clamped between the cooperating placement rings by a suitable locking member such as a wedge-shaped member inserted into an elongated slot provided in one of the placement rings which extends through a slot on a member provided in the cooperating placement ring. The placement rings can also be held together by a nut and bolt assembly. This arrangement necessitates an operation in which the wedge-shaped member must be inserted and hammered into position to assure firm engagement of the pipe connector gasket between the placement rings and subsequently to be removed by hammering. In addition, cast material as well as any other contaminants make it difficult to disassemble the placement rings after the cast member has been set.

Hole formers are used to make an opening for pipes to be mortared into place and packed in gaskets.

BRIEF DESCRIPTION OF THE INVENTION

The present invention is directed to a novel placement ring assembly which is characterized by comprising first and second placement ring members (mandrels) which are preferably formed of a plastic, fiberglass or metal material. The inside and outside mandrels are provided with centrally located interlocking portions which inter-fit with one another when assembled to prevent the inside and outside mandrels from relative movement in mutually perpendicular directions, as well as preventing any relative rotational movement therebetween.

The inside and outside mandrels are further provided with aligned openings through which the permanent magnet of a magnet assembly is inserted. The permanent magnet of the permanent magnet assembly firmly secures the mandrel assembly and the pipe connecting gasket to the inside core or outside jacket of a casting mold.

The magnet assembly is provided with a safety stop for positioning the mandrel and a mechanical release to release the mandrel assembly from the mold assembly without the need for a prying type or impact type tool.

In view of the fact that the casting material frequently causes the mandrel members to adhere to one another, it is often necessary to pry the mandrel members apart. To facilitate the separation of the mandrel members, the inner mandrel member is provided with a plurality of knockout pads arranged at spaced intervals about the central portion of the inside mandrel which are arranged to be struck by a hammer. The knockout pads are formed of a suitable rugged metallic material of a suitable thickness which is secured to the inside mandrel by a fastener assembly. A rubber cushion is arranged between the metal knockout pad and the inside mandrel to cushion the knockout blows and thereby prevent the mandrels from being permanently damaged.

The present invention is further directed to one-piece hole formers which are provided with a magnet assembly similar to that provided in the aforesaid placement ring assembly wherein the permanent magnet is attracted to an inside core member of a mold assembly formed of a magnetically attractive material. The magnet retains the hole former in its proper position during casting and the mechanical release separates the hole former from the inside core when the cast member has set.

OBJECTS OF THE INVENTION

It is therefore one object of the present invention provided a novel mandrel assembly for placement of a pipe connector gasket for accurate placement of a pipe connector gasket within a mold assembly utilizing magnetic means which accurately positions the pipe connector gasket and the inner and outer mandrels along the mold assembly without the need for additional fastening or positioning members.

Still another object of the present invention is to provide a mandrel assembly of the type described and in which the magnetic holding means is provided with a mechanical release, eliminating the need for additional tools for removing the permanent magnet and hence the mandrel assembly from the mold assembly.

Still another object of the present invention is to provide a mandrel assembly for positioning a pipe connector gasket within a mold assembly and which is provided with shock absorbing knockout pads to facilitate separation of the mandrels after a casting operation while preventing the mandrel members from being damaged.

Still another object of the present invention is to provide a one-piece type hole former provided with magnetic means to secure the hole former in proper position when casting a member in a mold and having a mechanical release for easily separating the hole former when the cast member has set.

Still another object is to provide a one-piece type hole former having cushioning knock-out means.

BRIEF DESCRIPTION OF THE FIGURES

The above as well as other objects of the present invention will become apparent when reading the accompanying description and drawings.

DETAILED DESCRIPTION OF THE INVENTION AND PREFERRED EMBODIMENTS THEREOF

Figure 2:
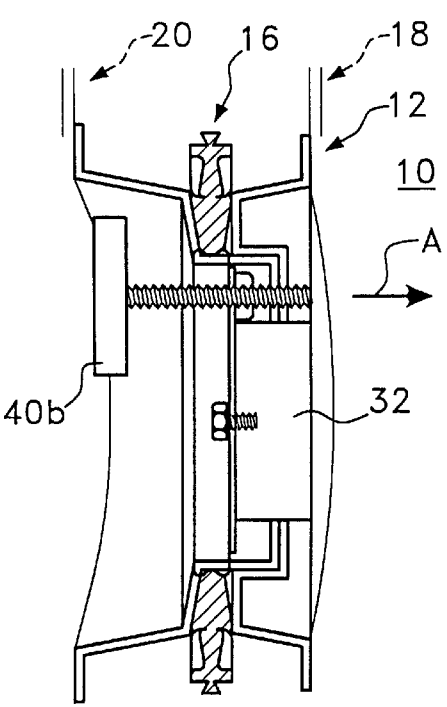
FIG. 2 shows a partially sectionalized view of the mandrel assembly of FIG. 1 in the fully assembled position.
Figure 1:
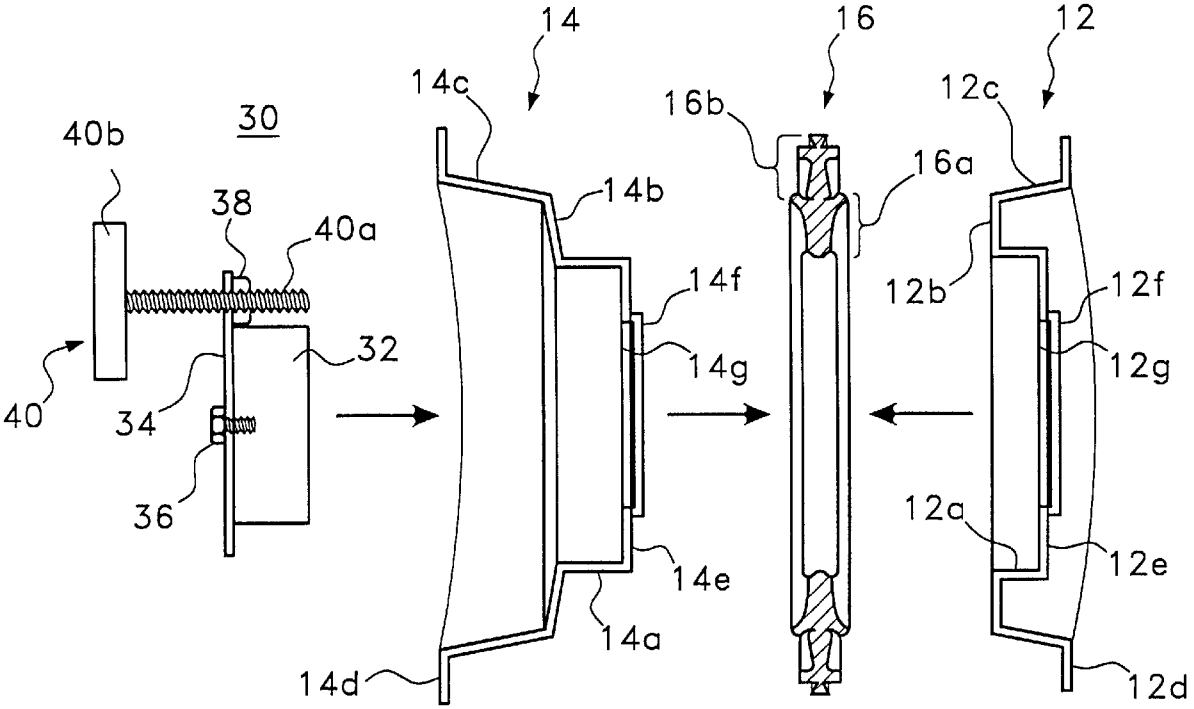
FIG. 1 shows an exploded cross-sectional view of a mandrel assembly embodying the principles of the present invention.

Making reference to FIGS. 1 and 2, the mandrel assembly 10 of the present invention is comprised of inside and outside mandrels 12 and 14 arranged to be assembled in the manner shown in FIG. 2 so as to accurately position a pipe connector gasket 16 therebetween. The cylindrical-shaped surface portion 14*a,* which is slightly tapered, is embraced by the cylindrical-shaped slightly tapered portion 12*a*. The flat surface portion 12*b* of inside mandrel 12 and the significantly tapered portion 14*b* of outside mandrel 14 embrace the inside portion 16*a* of gasket 16. The outer portion 16*b* of gasket 16 extends beyond portions 12*b* and 14*b* as can best be seen in FIG. 2 and is arranged to be imbedded within the cast material. Tapered portions 14*c* and 12*c* of outside and inside mandrels 14 and 12, together with outwardly directive flanges 14*d* and 12*d* serve to define the opening in the member being cast, as well as the shape of the opening.

The right-hand surface of flange 12*d* rests against the surface of a cylindrical-shaped inside core of the mold assembly, only a portion of the inside core 18 being shown for purposes of simplicity.

Similarly, left-hand surface of flange 14*d* rests against the adjacent surface of the outside jacket 20 of the mold assembly, only a portion of the outside jacket being shown for purposes of simplicity.

The central portions 12*e* and 14*e* of inside and outside mandrels 12 and 14 are provided with a cooperating interlocking male projection 14*f* and female recess 12*f* which prevent the inside and outside mandrels from relative sliding movement in a rotational direction while portions 12*a* and 14*a* prevent relative movement in mutually perpendicular directions.

Figure 3A:
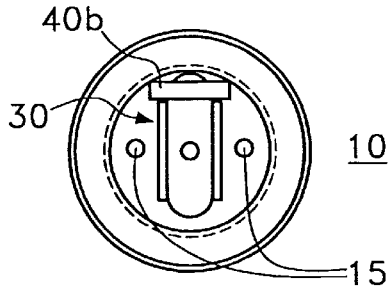
FIGS. 3*a* through 3*c* show front views of different size ranges of mandrel assemblies and the manner in which the magnet assemblies are arrayed.

The inside and outside mandrels 12 and 14 are assembled with the pipe connector gasket position therebetween. Fasteners 15 including cooperating threaded bolts and nuts (of conventional design) secure the mandrels 12 and 14 together (note, for example, FIGS. 3*a*–3*c*. The assembly is then placed against the inside core 18 as shown in FIG. 2.

A magnet assembly 30 comprising an inter-changeable permanent magnet 32, further includes a mounting plate 34 which serves as a safety stop for the positioning mandrel, as will be more fully described. A fastening member 36 threadedly engages a rearward portion of the permanent magnet 32 and secures the permanent magnet to the safety stop plate 34. A threaded nut 38 is secured to plate 34 and threadedly engages an elongated threaded rod 40*a* secured to an operating handle 40*b* of a mechanical release assembly 40.

With the members 12, 14 and 16 positioned in the manner shown in FIG. 2, the magnet assembly is inserted through the centrally located slots 14*g* and 12*g* in mandrels 12 and 14. Permanent magnet 32 in one preferred embodiment, may be a magnet having a pulling strength of 450 pounds. However, the pulling strength may be a greater or lesser value, depending upon the size of the mandrel being used.

The openings in cast members usually range from several inches to 24 inches or larger. As the openings and gaskets increase in diameter, it is necessary to provide additional clamping strength.

The inventors have found that, in mandrel assemblies up to twelve inch diameter, one magnet of the above type is sufficient. Magnet assembly 30 is arranged in the manner shown in FIG. 3*a*.

Figure 3B:
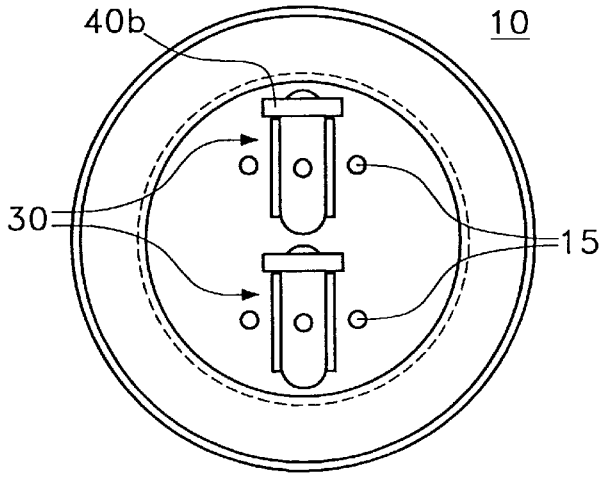

For openings in the range from 15 through 18 inches, two magnets are preferred. FIG. 3*b* shows the manner in which two (2) magnet assemblies are arranged.

Figure 3C:
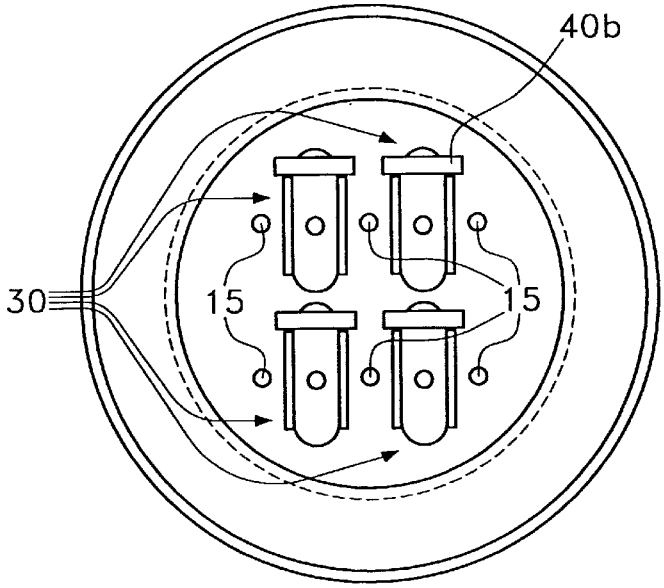

In openings having diameters in the range from 18 through 24 inches it has been found that four magnets are preferred. FIG. 3*c* shows the manner in which four (4) magnet assemblies are arranged.

When the mandrel assembly 10 is properly aligned within the mold assembly, in the manner shown in FIG. 2, the cast material is poured into the mold assembly. Conventional techniques are utilized for pouring and setting the cast material. Once the cast material is set, the permanent magnet (or magnets) are displaced from the position shown in FIG. 2 by rotating handle 40*b* in a direction causing the threaded nut 38 to move the threaded rod 40*a* toward the right as shown by arrow A in FIG. 2 so that the right-hand end of threaded rod 40*a* bears against an adjacent surface of inside core 18 causing the permanent magnet to be "tilted" relative to the inside core 18. As handle 40*b* is turned still further, the upper end of permanent magnet 32 is urged away from the surface of inside core 18. When a sufficient length of rod 40*a* is extended beyond the position shown in FIG. 2, the magnetic attraction between permanent magnet 32 and inside core 18 is reduced sufficiently to allow an operator to simply pull the permanent magnet away from inside core 18 with relative ease. The inner and outer mandrels are then removed from the mold assembly and separated from one another. The embedment portion 16*b* of gasket 16 is embedded in the casting material and becomes an integral part thereof. The pipe receiving portion 16*a* extends radially inwardly from the opening formed by mandrel portions 12*c* and 14*c* and is designed to form a liquid-tight seal with the external surface of a pipe extended therethrough.

Figure 4:
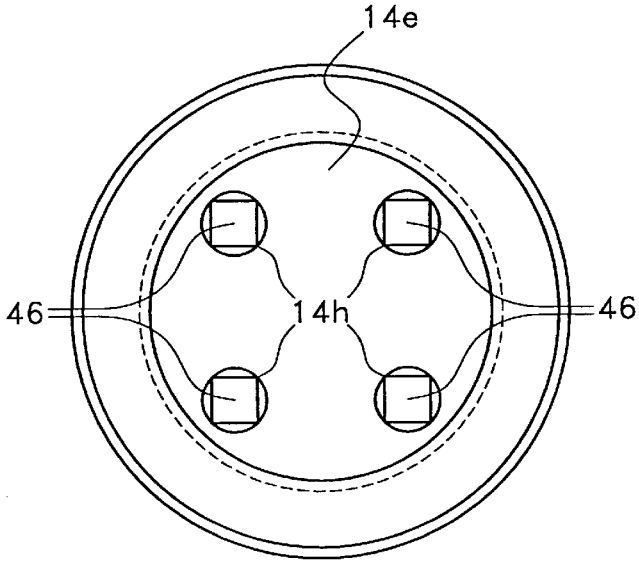
FIG. 4 is a front view showing a mandrel assembly employing knockout pads.
Figure 4A:
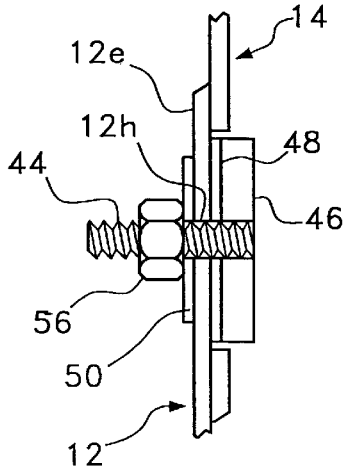
FIG. 4*a* is a detailed end view of one of the knockout pads shown in FIG. 4.

In instances where the inner and outer mandrel members remain adhered to one another, even after removal of the permanent magnet assembly (or assemblies) 30 and the fastening assemblies 15, the mandrel assembly is preferably provided with a plurality of knockout pad areas, as can best be seen in FIGS. 4 and 4*a*. The outside mandrel 14 is provided with a plurality of openings 14*h* arranged at substantially equi-spaced intervals as shown in FIG. 4.

Regions of the surface portion 12*e* of inside mandrel 12 which are aligned with openings 14*h* are each provided with an opening 12*h* for receiving a threaded rod 44 which is embedded within a thick metal knockout pad 46, and is preferably welded thereto. A rubber cushion 48 is positioned between surface 12*e* and metal knockout pad 46. A metallic washer or plate 50 is arranged against the left-hand side of surface 12*e*. A threaded securing nut 52 threadedly engages threaded rod 44 and is tightened to secure the metal knockout pad to the inner mandrel 12.

The manner in which the mandrel assembly is separated is, after the magnets are removed in the manner described hereinabove, a bleed through of concrete around the inside and outside edges of the mandrel assembly 10 is removed.

The fasteners 15 are removed and the inside mandrel 12 is struck, preferably with a four pound dead blow hammer against each of the metal pads 46, preferably in a clock-wise direction. The thick metal knockout pads adequately withstand the striking force of the hammer. The compressible rubber cushion 48 absorbs the impact of the hammer and protects the inside mandrel 12 from being damaged.

Figure 5:
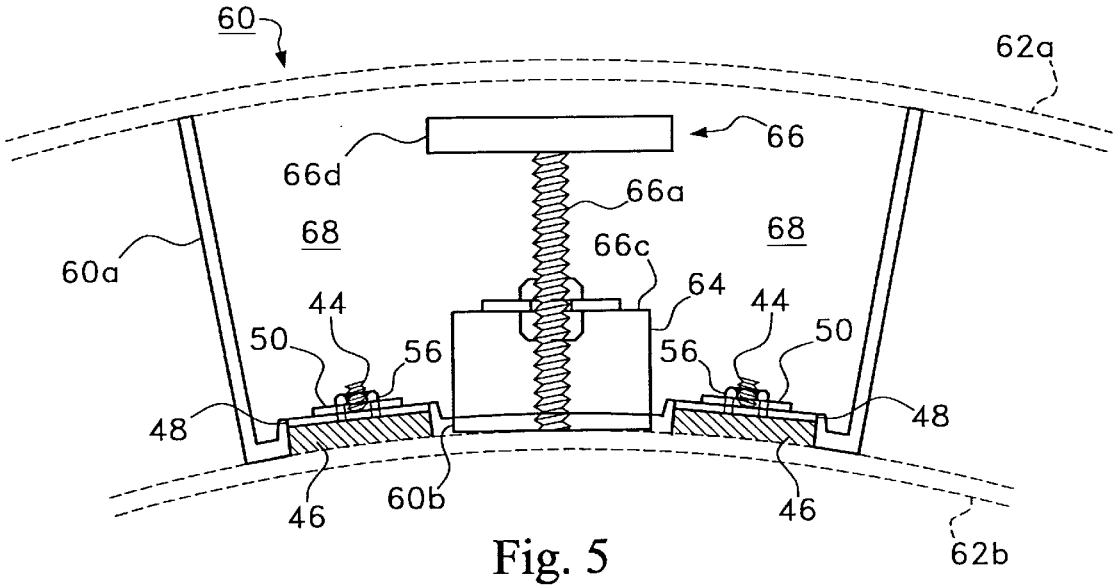
FIG. 5 is a simplified sectional view of a hole former embodying the principles of the present invention.

FIG. 5 shows another embodiment of the present invention in which an annular-shaped hole former 60 is fitted between an outside jacket 62*a* and an inside core 62*b* of a mold assembly 60. The truncated, conical-shaped surface defines the hole formed by hole former 60 within the cast member produced in the mold assembly. The inside core 62*b* preferably has a recess conforming to the perimeter of the permanent magnet assembly 64 to properly align the hole former within mold assembly 62. An opening 60*b* is provided in hole former 60 conforming to the perimeter of magnet assembly 64. The release assembly 66 is comprised of threaded rod 66*a* threadedly engaging tapped nut 66*b* secured to the top of magnet assembly 64 by plate 66*c*. Release handle 66*d* is provided to be easily gripped and turned by an operator. When rotated in a direction to move rod 66*a* downwardly, the permanent magnet assembly 64 separates from the inside core 62*a*. The opening 64*a* may either be spaced from threaded rod 66*a* or may be tapped to threadedly engage the threaded rod 66*a*.

Hole former 60 may be provided with knock-out pad assemblies 68 substantially identical in design and function to the knock-out pads shown in FIGS. 4 and 4*a* including metallic pads 46, threaded rod 44, nut 56, plate 50, and rubber cushion 48. Openings (not shown) are provided in hole former 60 to accommodate threaded rods 44 of the knock-out pads 46. The portion 60*b* of the hole former is sandwiched between the plate 50 on one side and the rubber cushion 48 and knock-out pad 46 on the other side (as shown in FIG. 4*a*). Openings are provided in inner core 62*b* which are in alignment with the openings 60*c*. The hole former may be removed from the cast member by striking one or more of the pads 46 with a suitable hammer before removing the cast member from the mold assembly. The knock-out pads 46 may also be struck by a hammer after removal of the cast member from the mold assembly to facilitate removal of the hole former from the cast member, if necessary.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. An apparatus for embedding a gasket within a concrete member formed within a mold having a metallic core, comprising:

first and second mandrel members having cooperating surfaces for securing and aligning the gasket therebetween, the first and second mandrel members having co-aligned openings in a central portion thereof;

a magnet assembly including a permanent magnet inserted through the co-aligned openings of the first and second mandrel members for securing the apparatus to the metallic core of the mold; and mechanical release means for releasing the permanent magnet from the metallic core to remove the apparatus.

2. The apparatus according to claim 1 wherein said mechanical release means comprises a threaded rod threadedly connected to said magnet assembly for separating the permanent magnet assembly from said core upon rotation of a release handle coupled to said threaded rod.

3. The apparatus of claim 1 wherein the first and second mandrel members further include means for positioning and holding the gasket for embedment into cast material placed in said mold.

4. An apparatus for forming a hole in a cast member formed in a mold assembly including an inner core and an outer jacket that define a mold region for receiving material to form the cast member, the apparatus comprising:

a member having an annular-shaped surface for defining an opening in the cast member;

a magnet assembly including a permanent magnet inserted through an opening in a portion of the member for aligning and magnetically securing the member to a metallic portion of one of said outer jacket and said inner core, the magnet assembly being connectable to the member to prevent movement of the member in a first direction generally perpendicular to the one of said outer jacket and said inner core and to prevent movement of the member in a second direction generally perpendicular to the first direction; and mechanical release means for releasing the permanent magnet from the one of said outer jacket and said inner core to remove said member from the mold assembly.

5. The apparatus according to claim 4 wherein said mechanical release means comprises a threaded rod threadedly connected to said magnet assembly for separating the permanent magnet assembly from said core upon rotation of a release handle coupled to said threaded rod.

6. An apparatus for embedding a gasket within a concrete member formed within a mold having a metallic core, comprising:

first and second mandrel members having cooperating surfaces for securing and aligning the gasket therebetween, the first and second mandrel members having co-aligned openings in a central portion thereof and means for positioning and holding the gasket for embedment into cast material placed in said mold;

a magnet assembly including a permanent magnet inserted through the co-aligned openings of the first and second mandrel members for securing the apparatus to the metallic core of the mold; and mechanical release means for releasing the permanent magnet from the metallic core to remove the apparatus, wherein said mechanical release means comprises a movable release member extending along one side of said magnet assembly to tilt one end of the magnet assembly away from the metallic core when the movable release member is operated to facilitate release of a magnetic attraction of said magnet assembly to said metallic core.

7. The apparatus of claim 6 wherein said magnet assembly has a release means mounting plate extending beyond a side of said magnet assembly;

said movable release member threadedly engaging said release means mounting plate, enabling the movable release member to move against the metallic core when rotated.

8. The apparatus of claim 7 wherein said release member is provided with a handle for gripping by a user to facilitate rotation of said release member.

9. The apparatus of claim 7 comprising fastening means for securing said release means mounting plate to said magnet assembly.

10. The apparatus of claim 9 further comprising a tapped member secured to said release means mounting plate having its opening in alignment with a clearance opening in said release means mounting plate; and said release member extending through said clearance opening and threadedly engaging said tapped opening.

11. An apparatus for forming a hole in and embedding a gasket in a cast member formed in a mold assembly defining a mold region and including a metallic core, the mold assembly being adapted to receive material to form the cast member, comprising:

first and second mandrel members having cooperating surfaces adapted to secure and align the gasket therebetween;

first and second magnet assemblies, each including a permanent magnet inserted through co-aligned openings in a central portion of the first and second mandrel members for securing the apparatus to the metallic core of the mold assembly; and mechanical release means for releasing the first and second magnet assemblies from the metallic core to remove the apparatus from the mold assembly.

* * * * *